United States Patent [19]

Dahlem

[11] 4,085,592

[45] Apr. 25, 1978

[54] SHIELD TUBBING FOR LONGWALLS

[75] Inventor: Werner Dahlem, Moers, Germany

[73] Assignee: Rheinstahl AG, Germany

[21] Appl. No.: 655,155

[22] Filed: Feb. 5, 1976

[30] Foreign Application Priority Data

Feb. 13, 1975 Germany ..... 2506076

[51] Int. Cl.[2] ..... E21D 15/44

[52] U.S. Cl. ..... 61/45 D

[58] Field of Search ..... 61/45 D; 299/31-33; 248/357; 91/170 MP

[56] References Cited

U.S. PATENT DOCUMENTS

| | | | |
|---|---|---|---|
| 3,779,023 | 12/1973 | Koppers | 61/45 D |
| 3,885,396 | 5/1975 | Snowden et al. | 61/45 D |
| 3,932,998 | 1/1976 | Lubojatsky et al. | 61/45 D |

FOREIGN PATENT DOCUMENTS

| | | | |
|---|---|---|---|
| 2,321,233 | 11/1973 | Germany | 61/45 D |
| 2,261,035 | 7/1974 | Germany | 61/45 D |
| 2,304,528 | 8/1974 | Germany | 61/45 D |
| 2,422,591 | 11/1975 | Germany | 61/45 D |

*Primary Examiner*—Dennis L. Taylor
*Attorney, Agent, or Firm*—McGlew and Tuttle

[57] ABSTRACT

A shield tubbing for longwalls comprises a support tub and a break shield is pivotally mounted on said support tub. A double arm balance beam is pivotally supported on said tub and it includes a first arm portion which is connected at one end to a hydraulic ram. The hydraulic ram is connected to act against the break shield. The second arm of the balance beam bears on the shield between the pivotal support of the shield and the point of connection of the ram to the shield.

7 Claims, 2 Drawing Figures

SHIELD TUBBING FOR LONGWALLS

BACKGROUND OF THE INVENTION

1. Field of the Invention

This invention relates in general to the construction of shield devices for excavations and in particular to a new and useful shield tubbing for longwalls which includes a break shield mounted pivotally on a back filling side of a bottom tub and with at least one hydraulic ram supporting the break shield which determines the setting load and the carrying capacity of the tubbing.

2. Description of the Prior Art

In the known shield tubbings the shield bears in the range of the face of the roof with the interposition of a roof cap. The shield is supported by a longitudinally adjustable and principally hydraulically operated ram which is also supported on the ground sill. A shield tubbing frame is known which includes a shield formed by an angle lever whose lower arm acts on a piston cylinder assembly which is mounted in the ground sill along its longitudinal axis. In all shield tubbing frames according to the state of the art at least one hydraulic cylinder must transmit the entire setting load and the nominal load to the ground sill. Beyond that the cross-section of the shield must be so designed that it can absorb the load acting on it as carrier on two supports.

SUMMARY OF THE INVENTION

The invention provides a shield tubbing constructed so that for a given load of the hydraulic ram, its dimensions and the expenditure for the associated hydraulic parts are lower than that of the prior art structures or with a hydraulic ram of given dimensions the carrying capacity of the tubbing is increased. In addition the device provides a more uniform support of the shield.

In accordance with the invention a balance beam is mounted in the bottom tub and a hydraulic ram is articulated on one arm of the balance beam and braced against the break shield. The other arm of the balance beam bears directly or indirectly on the break shield between the point of action of the hydraulic ram and the bearing for the break shield in the bottom tub. The balance beam can be arranged in different ways in the tubbing frame. For a shield tubbing whose shield is supported by a vertical hydraulic ram the invention provides that the arm of the beam which is remote of the ram bear on the break shield over a compression member which is articulated on both sides. In a shield tubbing where the break shield is designed as an angle lever mounted in the bottom tub, the hydraulic ram is arranged substantially horizontal in the bottom tub and bears with one end over connecting links on the shorter lever arm of an angle designed as a break shield and with its other arm on one arm of the balance lever. The other arm bears on the shorter arm of the angle lever.

In order to obtain optimum load conditions depending on the mining conditions the invention suggests in a further development that the arms of the balance beam be adjustable in length.

Accordingly it is an object of the invention to provide an improved shield coating for longwalls which comprises a break shield pivotally supported on the tubbing along with a balance beam which has one arm connected through a hydraulic ram to the shielding and another arm connected to bear on the shield between the pivotal support for the shield and the point of connection of the ram to the shield.

A further object of the invention is to provide a shield tubbing for longwalls which is simple in design, rugged in construction and economical to manufacture.

For an understanding of the principles of the invention, reference is made to the following description of typical embodiments thereof as illustrated in the accompanying drawings.

GENERAL DESCRIPTION OF THE PREFERRED EMBODIMENTS

Figure 1:
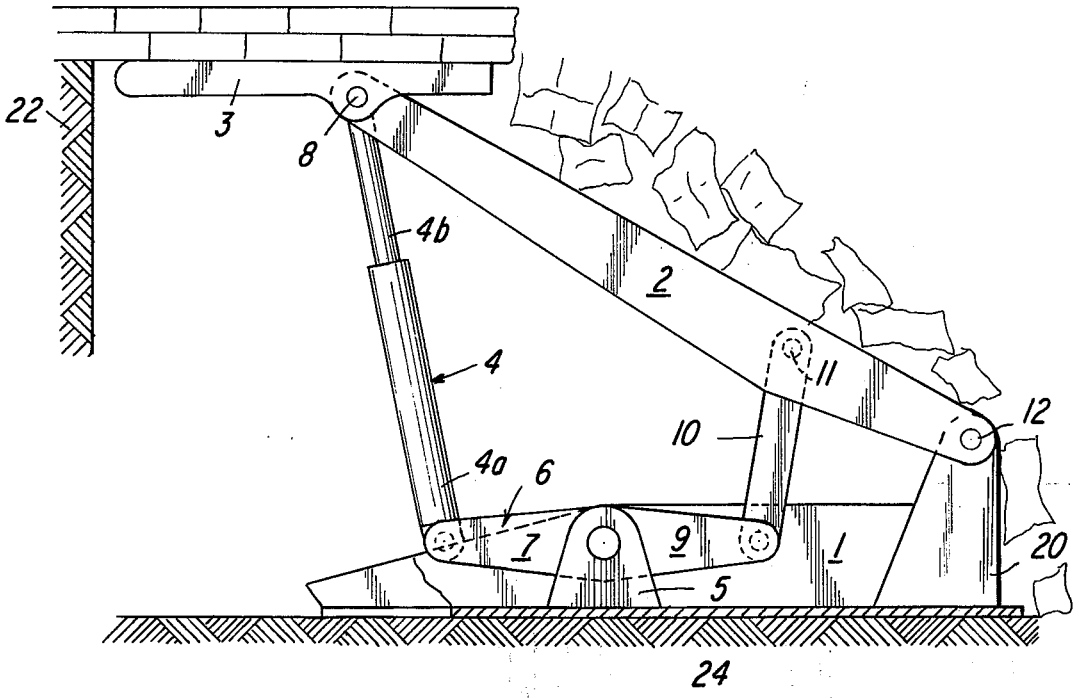
FIG. 1 is a schematic side elevational view of a shield tubbing with a vertical acting fluid pressure operated ram which bears on the shield and is constructed in accordance with the invention.

Referring to the drawings in particular the invention embodied therein in FIG. 1 comprises a shield tubbing which comprises a bottom tub 1 having a pedestal or bracket 20 thereon which defines a pivotal support bearing 12 for supporting one end of a break shield 2. The opposite end carries a roof cap 3 which which is positioned against a roof of an excavation wall 22. The bottom tub 1 is arranged along a floor 24 and it carries an upstanding bracket or pivot 5 for pivotally supporting a balance beam generally designated 6 below the shield 2. One arm 7 of the balance beam 6 carries a fluid pressure operated ram 4 which includes a base part **4*a* and one or more telescopic parts 4*b* having their upper end connected at 8 to the upper end of the break shield 2 at the location where it is articulated to the roof cap 3. The other arm 9 of the balance beam 6 supports shield 2 at the location of the bearing 11 which is at a point between bearing 12 and the point of action 8 of the hydraulic ram 4. A compression member 10 is disposed between the end of the second arm 9 and the bearing 11**.

In the arrangement described the load resting on the roof cap 3 and the break shield 2 is transmitted over the hydraulic ram 4 and over the compression member 10 to the balance beam 6 and from here through the support 5 to the bottom tub 1 and thus to the sole or floor 24.

Figure 2:
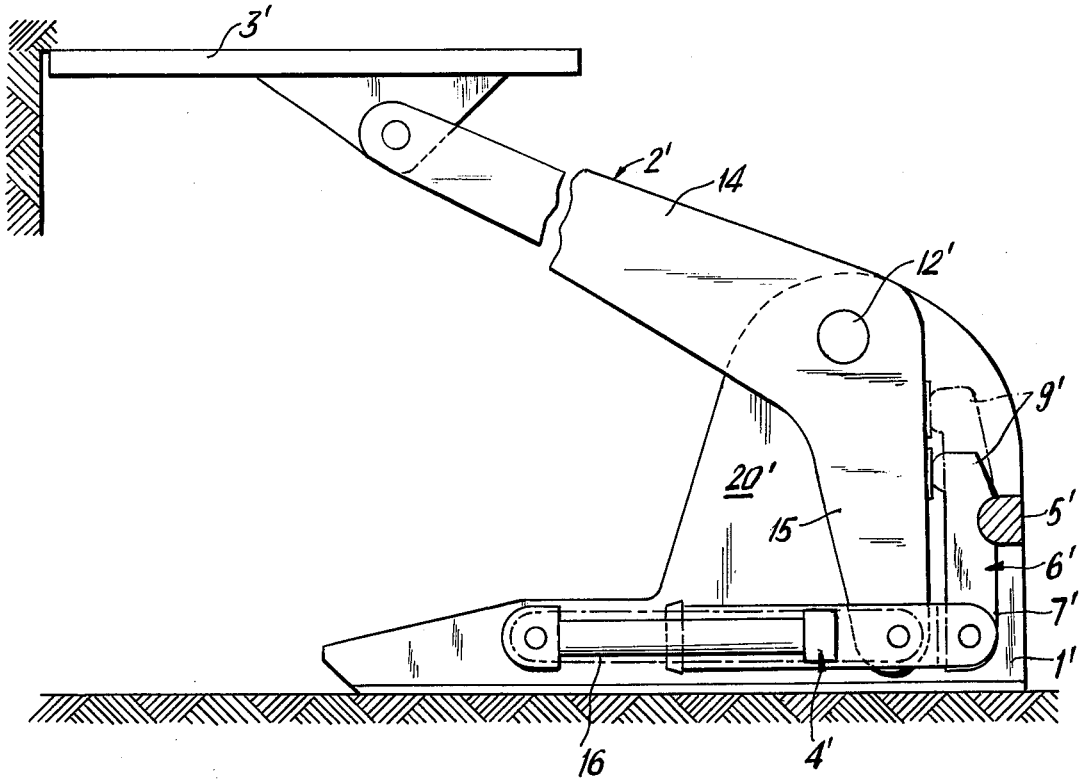
FIG. 2 is a view similar to FIG. 1 of another embodiment of the invention wherein the fluid pressure operated ram is arranged horizontally.

In the embodiment shown in FIG. 2 similar parts are similarly designated but with primes. The break shield generally designated 2' comprises a double arm lever including a long arm part 14 and a short arm part 15 and it is pivotally mounted on a bearing 12' of a pedestal 20'. Longer arm 14 carries a roof cap 3' and the shorter arm 15 is connected at its outer end with the fluid pressure operated telescopic device or hydraulic ram 4'. The ram 4' is pivoted at its inner end on an arm 7' of the balance beam 6'. The other arm 9'of the balance beam 6' bears on the shorter lever arm 15 of the break shield 2' between its pivot bearing support 12' and the point of action of the hydraulic ram 4. Balance beam 6' is pivotally mounted on support 5' in the bottom of tub 1'.

A special advantage of the invention is that it is possible, by varying the length of the arms 7 and 9 of the balance beam 6 to keep the load of the hydraulic ram 4 substantially constant even if the nominal load varies during the operation.

The compression member 16 shown in the embodiment of FIG. 2 is variable in length in order to adapt to the varying heights of the tubbing or to the varying length of the arms 7′ and 9′ of the balance 6′.

While specific embodiments of the invention have been shown and described in detail to illustrate the application of the principles of the invention, it will be understood that the invention may be embodied otherwise without departing from such principles.

What is claimed is:

1. A shield tubbing for longwalls, comprising a support tub, a break shield, break shield pivotal support means pivotally supporting said break shield on said tub, a double arm balance beam having first and second arms, balance beam support means pivotally supporting said balance beam on said tub, a hydraulic ram having one end acting adjacent the end of said balance beam first arm and an opposite arm connected to said break shield, said second arm of said balance beam bearing on said shield between said pivotal support means and the connection of said ram to said shield.

2. A shield tubbing according to claim 1, wherein said balance beam is disposed substantially horizontally.

3. A shield tubbing according to claim 1, wherein said balance beam is disposed substantially vertically.

4. A shield tubbing according to claim 1, including a roof cap connected to the upper end of said break shield, said break shield pivotal support means comprising an upstanding bracket having a pivot for pivotally supporting one end of said break shield, said balance beam extending horizontally below said break shield and a compression member extending between said opposite arm of said balance beam and said break shield.

5. A shield tubbing according to claim 1, wherein said break shield comprises an angle lever member having a first arm portion extending upwardly from said break shield pivotal support means and a second arm portion extending downwardly from said break shield pivotal support means, said balance beam extending vertically behind said second arm portion and said opposite arm of said balance beam being connected to said second arm portion of said break shield, said hydraulic ram extending substantially horizontally and being connected between the lower end of said second arm portion of said break shield and said balance beam first arm.

6. A shield tubbing for longwalls having a roof face, comprising a support tub having a horizontal portion and an upstanding pedestal portion, a roof cap engageable with the roof face, an angle lever break shield pivotally mounted on said upstanding pedestal portion above said horizontal portion and having a long arm portion extending obliquely upwardly and having a top end pivotally connected to said roof cap and having a short arm portion extending downwardly, a balance beam having an upper end bearing against said short arm portion and an opposite lower end, a pivot bearing on said upstanding pedestal portion and bearing against said balance beam between said upper and lower ends thereof and pivotally supporting said balance beam, a compression member having one end pivoted to said support tub and an opposite end connected to said lower end of said balance beam, and fluid pressure operated ram means connected between said short arm portion and said support tub.

7. A shield tubbing for longwalls having a roof face, comprising a support tub having a horizontal portion and an upstanding pedestal portion, a roof cap engageable with the roof face, a lever brake shield pivotally mounted on said upstanding pedestal portion and having an outer end pivotally connected to said roof cap, a balance beam pivotally mounted on the horizontal portion of said support tub and having respective first and second lever arm portions on respective ends of the pivotal mounting thereof, a compression member connected between said second arm portion and said roof face break shield, fluid pressure operated ram means connected between said first arm portion and said roof cap at the connection of said angle lever break shield to said roof cap.

* * * * *